United States Patent [19]

Schweitzer et al.

[11] 4,085,798

[45] Apr. 25, 1978

[54] METHOD FOR INVESTIGATING THE FRONT PROFILE DURING FLOODING OF FORMATIONS

[75] Inventors: Jeffrey S. Schweitzer, Ridgefield; Ralph M. Tapphorn, Danbury, both of Conn.

[73] Assignee: Schlumberger Technology Corporation, New York, N.Y.

[21] Appl. No.: 750,846

[22] Filed: Dec. 15, 1976

[51] Int. Cl.[2] ..... E21B 47/00; G01V 5/00; G01T 1/00

[52] U.S. Cl. ..... 166/252; 166/248; 250/260

[58] Field of Search ..... 166/252, 251, 250, 248; 250/256, 253, 258–260, 262, 261, 270

[56] References Cited

U.S. PATENT DOCUMENTS

| | | | |
|---|---|---|---|
| 2,318,689 | 5/1943 | Hodell et al. | 166/252 |
| 2,769,913 | 11/1956 | Mazzagatti | 250/260 |
| 2,788,071 | 4/1957 | Pelzer | 166/251 X |
| 2,888,569 | 5/1959 | Jones | 250/260 |
| 3,002,091 | 9/1961 | Armstrong | 250/259 X |
| 3,035,638 | 5/1962 | Parker et al. | 166/251 X |
| 3,134,904 | 5/1964 | Hubbard, Jr. et al. | 250/260 |
| 3,461,291 | 8/1969 | Goodman | 250/262 |
| 3,463,922 | 8/1969 | Senftle et al. | 250/253 X |
| 3,546,512 | 12/1970 | Frentrop | 313/61 S |
| 3,562,523 | 2/1971 | Richardson et al. | 250/259 |
| 3,633,030 | 1/1972 | Antkiw | 250/261 |
| 3,851,171 | 11/1974 | Saniford et al. | 250/259 |
| 3,874,451 | 4/1975 | Jones et al. | 166/252 |
| 3,993,131 | 11/1976 | Riedel | 166/252 |

*Primary Examiner*—Stephen J. Novosad
*Attorney, Agent, or Firm*—Brumbaugh, Graves, Donohue & Raymond

[57] ABSTRACT

A method of determining the flood front profile created during the production flooding of an oil-bearing formation utilizes cased observation boreholes located between the injection wells and the producing wells. The time and depth of arrival of the flood front at an observation borehole are detected by gamma ray spectroscopy examination of the formation. Tracer elements having characteristic gamma ray emission energies are employed to facilitate detection of the flood front and its direction of travel. The tracer elements may be naturally radioactive substances or they may be normally stable elements which are rendered radioactive by neutronbombardment. Elements having interfering spectral lines may be separated on the basis of half-life measurements, selective detection periods or the response of the elements to different energy neutrons. By repeating the detection process at different depths and times, the profile of the flood front as it approaches the producing wells may be developed. This information may be used to control the flooding operating to prevent or localize premature breakthrough to the producing wells.

26 Claims, 7 Drawing Figures

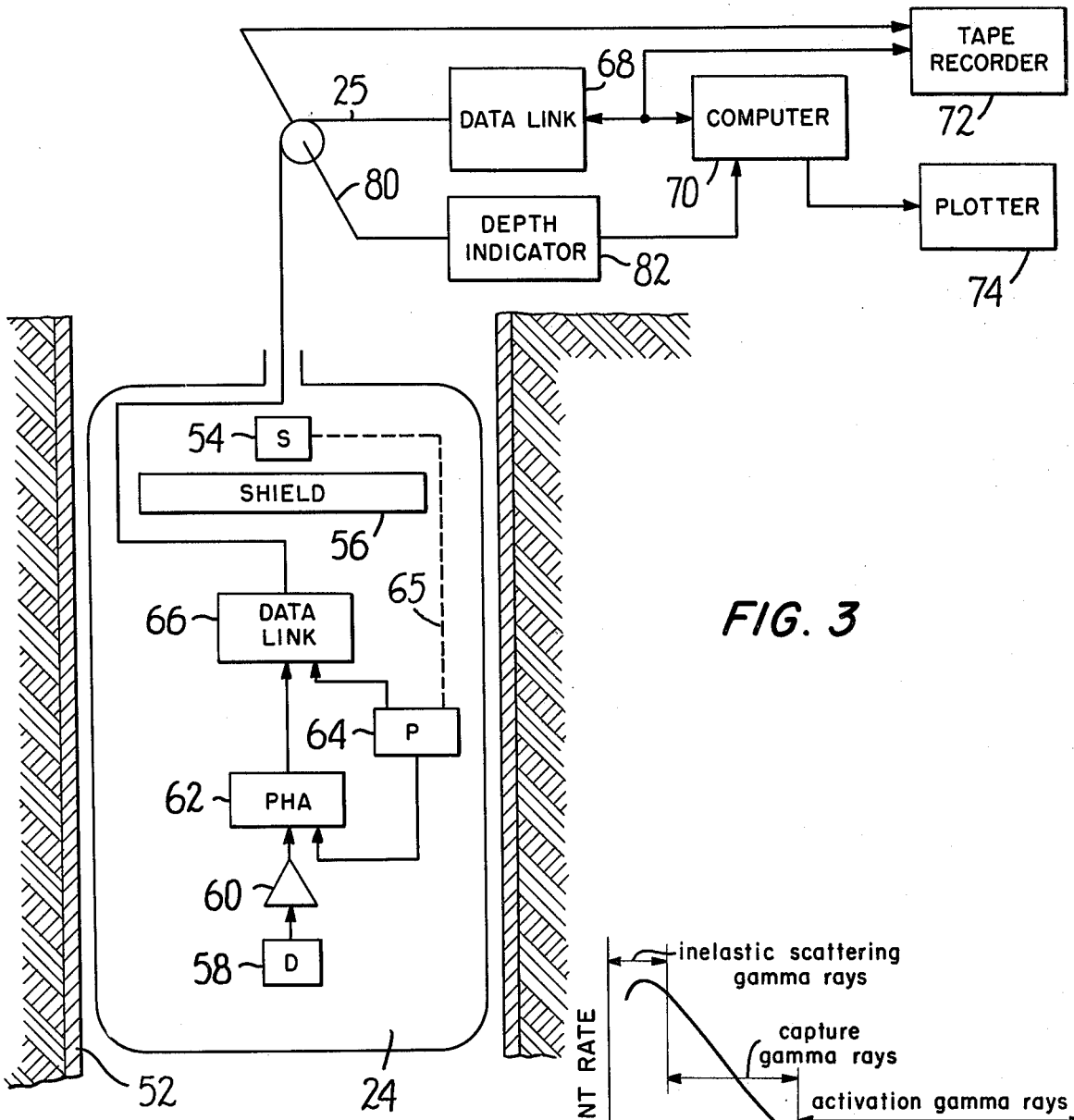
FIG. 3
FIG. 4
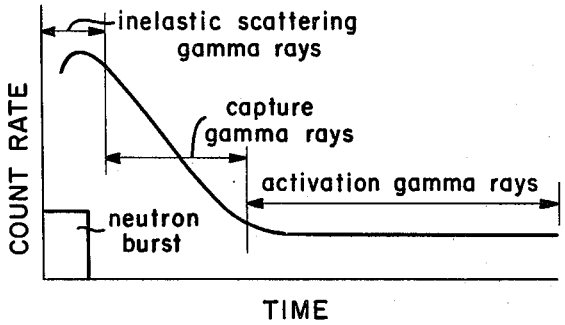
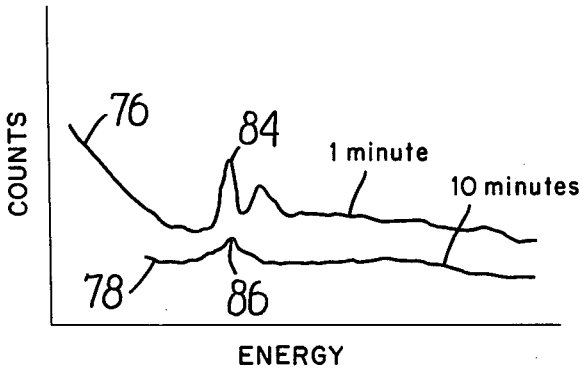
FIG. 5
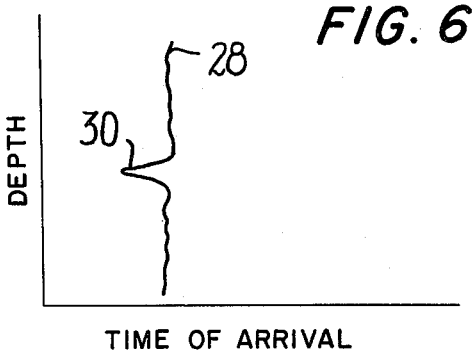
FIG. 6

METHOD FOR INVESTIGATING THE FRONT PROFILE DURING FLOODING OF FORMATIONS

BACKGROUND OF THE INVENTION

1. Field of the Invention

This invention relates to secondary and tertiary methods of oil recovery and, more particularly, to improved methods for determining the progress and shape of a flood front when oil is recovered by flooding a formation.

2. The Prior Art

In oil production, primary drilling and pumping operations are frequently ineffective to recover a substantial proportion of the available oil, often leaving as much as 30 to 70% of the oil as residual. It is common, therefore, to employ so-called secondary or tertiary methods to obtain the additional oil. One such secondary or tertiary method involves flooding the producing formation with an oil-displacement fluid, such as water, steam, gases, etc., through one or more injection wells spaced from the producing well. As the leading edge, or front, of the flood fluid progresses through the formation, the oil in the formation is pushed towards the producing well. Where plural injection wells are used, the fluids from neighboring wells may merge to form a combined front, and such combined front may indeed completely surround a producing well.

It is important in maximizing the amount of oil recovered to be able to determine the direction and speed of movement of the flood front through the producing formation. Typically, however, a flood front does not progress uniformly from the injection well or wells to the producing well because the formations are usually not uniform. This non-uniformity is generally referred to as "fingering." For example, a flood front may follow a crevice in the formation and a "finger" of the flood front may "breakthrough" into the producing well, thus interrupting the production of oil. If it is known that only "fingering" has occurred and that the front has not reached the producing well, appropriate steps may be taken to prevent premature breakthrough. It is important, therefore, to know not only the location and time of arrival of the foremost edge of the flood front but also to have information of the movement and shape of the front as a whole. That is to say, for maximum oil production a complete description of the spatial shape, or "profile", of the front in the vicinity of the producing well is required.

Since oil-bearing formations differ significantly in matrix and fluid composition, it is desirable that the flood front detection process be carried out in a way which allows of the use of a wide variety of tracer elements and detection techniques, thereby permitting detection of the front or of different parts of the front in all formations likely to be encountered. Additionally, the detection process should not cause any significant interference in the movement of the front itself and should be capable of being made at a distance from the producing well sufficient to allow for modification of the flooding operation in order to maximize production.

One prior art approach to flood front detection is disclosed in U.S. Pat. No. 3,874,451 to Jones et al., according to which observation boreholes spaced from the injection wells are used to detect the arrival of the flood front by measuring a pressure change in the boreholes. By measuring the time it takes for the front to arrive at an observation borehole and knowing the distance from it to the injection hole, the progress of the front, which is related to the oil saturation, can be determined. A disadvantage of this method is that the observation boreholes must be uncased in order to measure the pressure; hence, they disturb the flood front and affect its progress. Also, the Jones et al. method does not determine the depth at which the front reached the observation well, and thus does not permit its profile to be ascertained.

U.S. Pat Nos. 2,888,569 to S. B. Jones and 3,002,091 to F. E. Armstrong disclose two other prior art techniques for detecting the arrival of a flood front. In the Jones technique, a beta-emitting tracer (e.g. krypton 85) is injected into a formation along with a flooding gas. The arrival of the flood (gas) front at the producing well is detected in the borehole with a beta detector. In the Armstrong technique, the flood fluid includes a normally stable element which is rendered unstable by neutron irradiation. At the producing well, the flood fluid is brought to the surface, separated from the oil, and bombarded with neutrons. A gamma ray detector is used to sense the presence of the unstable tracer element in the bombarded fluid. If present, it indicates that the flood fluid has reached the producing well. In both the Jones and Armstron methods, the detection of the tracer at the producing well represents a serious disadvantage because it interferes with production. These methods, moreover, afford no information about the front until it reaches the producing well. As a result, it is too late to take effective action to maximize the production of oil by controlling the flooding operation. In addition, with the Armstrong method the depth at which the front reaches the production well is not known since the detecting step is done uphole.

The foregoing and other disadvantages of the prior art are overcome by the present invention.

SUMMARY OF THE INVENTION

It is an object of the invention to provide an improved method of determining the progress of a flood front through an oil-bearing formation.

Another object of the invention is to provide such a method which affords a complete profile of the flood in the vicinity of a producing well.

A further object of the invention is to provide an improved method of flood front detection which permits in situ determination of the flood profile without interference with or disruption of the flood front.

Still another object of the invention is to provide a method of detecting the progress and shape of the flood front as it approaches a producing well in a manner permitting maximum oil recovery through control of the flood operation.

It is a further object of the invention to provide a flood front detection method which allows the use, for detection purposes, of a wide variety of tracer elements and detection techniques.

These and other objects are attained, in accordance with the invention, by detecting gamma rays emanating from the oil-bearing formation undergoing flooding at a number of elevations over its depth and obtaining, by spectral analysis of said detected gamma rays, an indication of the arrival of the flood front at each of the elevations examined. A complete vertical profile of the flood front may therefore be generated as the front reaches the observation borehole. By the use of plural observation boreholes spaced about the periphery of the producing well, information about the horizontal profile of the flood front may also be obtained. Such knowledge of the shape and progress of the flood front permits appropriate control of the flooding operation in order to maximize oil recovery. p According to the invention, the arrival of a flood fluid at an observation borehole is detected by gamma ray spectroscopy techniques, including, for example, spectral line analysis with or without half-life analysis. To that end, a tracer element having a characteristic gamma ray emission energy may be added to the flood fluid. The tracer element may be unlike any element normally found in abundance in the formation, in which case the presence of gamma rays of such characteristic energy at an observation borehole will indicate the arrival of the front, or it may be an element normally found in the formation, in which case the arrival of the front will be indicated by an increase in the magnitude of the spectrum at the characteristic energy. Also, the tracer employed may be a radioactive element or it may be a normally stable element which is rendered radioactive by neutron or gamma bombardment at the observation borehole. Alternatively, no particular tracer element need be used, and the arrival of the front may be detected by observing changes in the gamma ray spectrum for constituents of the formation.

According to another feature of the invention, more complete information concerning the shape and movement of the flood front may be obtained when a plurality of injection wells spaced around the producing well are used, by selecting a different tracer element for each injection well. Information is thereby obtained both as to the progress of the overall flood front and as to the movement and location of the flood fluids from each injection well. For example, the detection of more than one tracer at an observation borehole, or of a tracer different from that expected at such borehole, might indicate that the flood fluid from a particular injection well is moving more rapidly than the other fluids or that it has been diverted, e.g., due to a crevice in the formation, from its expected path. Corrective action, such as adjustment of the pumping rate at the injection well in question, may therefore be taken. In this way it is possible to monitor the progress of the individual injected flood fluids and, in response thereto, to adjust pumping operations among the injection wells to provide an overall flood front profile of optimum shape and effectiveness.

The gamma rays emanating from the formation are preferably detected at the observation borehole or boreholes over a comparatively broad energy range, e.g., 100 keV to 4 MeV, so that tracers having significantly different gamma ray energies may be utilized. This not only facilitates the identification of the several tracers but also allows for the simultaneous detection of flood fluid from a number of different injection wells at each individual observation borehole.

Although naturally occurring gamma rays may be detected in accordance with the invention, neutron bombardment is preferably employed to induce gamma ray emission since it affords greater flexibility in the identity and amounts of tracer elements used and in the spectroscopic techniques which can be employed. Thus, not only may stable elements be used as tracers, thereby allowing selection among a larger range of elements which may be employed and at the same time reducing radiation hazards, but selection may be made of specific types of gamma rays to be detected, e.g., inelastic scattering, capture or activation gamma rays. Also, neutron sources of different energy distributions may be used to distinguish between tracer elements and other elements having interfering spectral lines. Half-life analysis is likewise facilitated by neutron inducement of gamma ray emission.

A further important advantage of the invention, particularly where neutron bombardment is employed, is that gamma ray detection of the flood fluid front may be made through cased observation wells. This permits in situ determination of the flood front profile as a function of depth without disruption of modification of the profile.

BRIEF DESCRIPTION OF THE DRAWINGS

The foregoing and other features of the invention will be more readily apparent from the following detailed description and drawings of illustrative embodiments of the invention, in which:

FIG. 3 is a schematic diagram of a well logging tool useful in practicing the invention;

FIG. 4 is a graph of gamma ray activity resulting from irradiation of a formation with a pulse of neutrons;

FIG. 5 shows typical gamma ray energy spectra taken at two different times following neutron irradiation of a formation; and FIG. 6 is a graphical representation of a vertical flood front profile.

DETAILED DESCRIPTION

Figure 1:
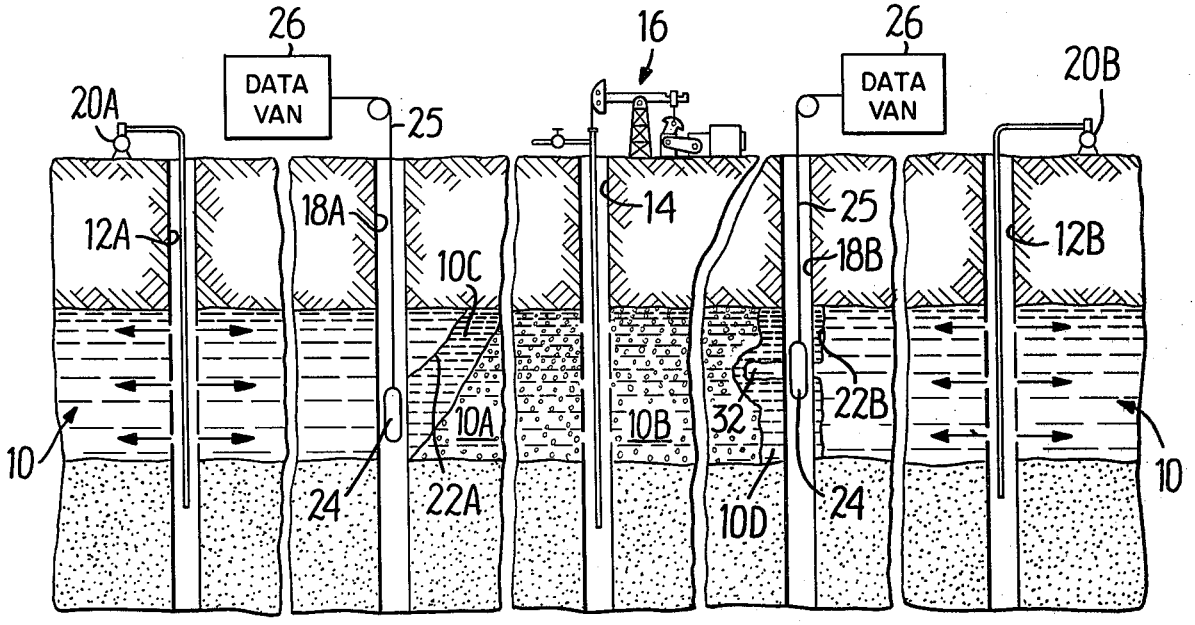
FIG. 1 is a section through an earth formation illustrating the detection of a flood front profile according to the invention.

In an illustrative embodiment of the invention, FIG. 1 depicts in section an oil-bearing formation 10 in which primary production methods have become unprofitable and secondary or tertiary flooding operations have been initiated. The formation 10 is shown as undergoing flooding through two injection wells 12A and 12B spaced on opposite sides of a producing well 14, through which oil is withdrawn by a pump 16. Observation boreholes 18A and 18B are located between the injection wells 12A and 12B and the producing well 14. It will be understood that the number and location of the injection wells and the observation boreholes may differ from that shown in FIG. 1, which is intended to be exemplary only. Both the producing well 14 and the injection wells 12A and 12B would normally be cased, with suitable perforations at the level of formation 10. In accordance with the invention, the observation wells are also preferably cased over the depth of the formation, but not perforated, to avoid disruption of the flood front. Advantageously, the wells already in existance in an oil field are used for these purposes, but where necessary new wells can be drilled.

A suitable flooding fluid, e.g. fresh water mixed with a surfactant, is pumped by pumps 20A and 20B into the injection wells 12A and 12B and expands radially therefrom through the formation 10 (indicated by the arrows in FIG. 1) driving the oil in the formation (indicated in zones 10A and 10B) towards the producing well 14. In addition to the residual oil, there would normally be some indigenous water in the formation, and the movement of the flood fronts 22A and 22B of the injected fluids causes a buildup of the formation water in oil-water zones 10C and 10D between the flood fronts 22A and 22B and the driven oil in zones 10A and 10B.

The progress of the flood fronts 22A and 22B is detected in observation boreholes 18A and 18B, respectively, by means of a well logging sonde or tool 24. Movement of the tool 24 through the boreholes 18A and 18B, which as noted are preferably cased, is accomplished by means of cables 25 connected in the usual manner to motor driven winches (not shown). As is conventional in well logging, the cables 25 also carry power to the downhole tool 24 and convey the data-bearing logging signals to the surface for processing and recording in a data van 26. In practice the flood fronts 22A and 22B move only on the order of a few inches to a foot per day. Therefore, one logging tool and data van would normally be sufficient effectively to cover all of the observation boreholes surrounding a producing well. Additional tools and data vans may of course be provided if desired or needed.

As is described in more detail hereinafter in connection with FIG. 3, the tool 24 includes a gamma ray detector of the type which generates an output signal whose amplitude is representative of the energy of the incident gamma ray. Although for purposes of the present invention any detector having an energy resolution suitable for detection of the elements of interest in the flood fluid may be used, the detector preferably comprises a high-resolution device such as a solid state Ge detector. Pulse height analysis circuitry is also provided, either in the tool 24 or in the data van 26, to sort the detector signals according to amplitude into a number of channels so as to generate energy spectra of the detected gamma rays. Representative spectra are illustrated in FIG. 5. Such spectra are used, in accordance with the invention, to detect the presence at an observation borehole of gamma rays known to originate from elements of the flood fluid as an indication of the arrival thereat of the flood front or fronts.

It is a feature of the invention that the detection of flood fluid fronts in accordance therewith permits the use both of a broad range of elements or isotopes and of a wide variety of spectroscopy detection techniques. Thus, the flood fluid elements detected may be either primary constituents of the fluid or tracer elements added to the fluid, and they likewise may be either radioactive (including both natural and man-made radioisotopes) or they may be normally stable elements which are rendered radioactive by neutron or gamma bombardment. Suitable radioactive elements might include, for example, uranium, thorium and potassium, while suitable stable elements might include aluminum, sodium, magnesium, as well as isotopically enriched stable elements. The elements selected for detection need not be different from elements naturally present in the borehole or formation, as provision is made for determining the concentration of any formation elements of interest, such as by generating individual or composite spectra of such elements, prior to the arrival of the flood front at the observation point. For instance, since formation water (zones 10C and 10D in FIG. 1) normally contains NaCl, the arrival of the flood front 22A or 22B, assuming a fresh water flood, could be signalled by a reduction in the NaCl spectrum or the Cl spectrum. Alternatively, thermal decay time measurements, such as those described in U.S. Pat. No. Re 28,477 to W. B. Nelligan, may also be used to detect the arrival of the front under these circumstances.

Where a tracer is added to the flood fluid, the particular concentration required for detection purposes will depend upon a number of factors, including the half-life of the tracer, the radiation source strength, the porosity of the formation, the neutron capture cross section of the tracer, the energy of the gamma rays emitted by the tracer, the relative branching of the tracer as it decays and the fraction of the decay events which emit gamma rays, other constituents in the formation or borehole with spectral lines near the line for the tracer, and the like. Generally, information on the required concentration will not be known precisely beforehand. Based on the foregoing factors, however, reasonable estimates of such concentrations can be made or can be determined by routine experimentation.

A number of spectroscopy techniques may be employed to optimize detection, depending upon the emission characteristics of the elements to be detected and the presence of interfering emissions by other elements in the formation surrounding the borehole. In the absence of interfering spectra, detection may be made in a straightforward manner from the amplitude of the detected spectrum at the characteristic gamma ray energy of the element of interest. If interfering gamma rays from another element (referred to as a "contaminant" because it contaminates the spectrum of the tracer) are present, detection may be aided by half-life determinations or, where neutron bombardment is used, by selectively detecting the formation gamma rays on a time basis to sense only those originating from a particular type of neutron reaction, such as inelastic scattering, capture, or activation processes. Again, a desired element may be distinguished in the presence of interfering gamma rays from a contaminant by irradiating the formation separately with neutrons of two different mean energies. For example, if the element of interest has a higher threshold than the contaminant for the particular gamma ray reaction to be detected, one neutron source will have an energy above the threshold of the element and the other source will have an energy below said threshold but above the threshold of the contaminant. Comparison of the two resulting spectra then permits determination of whether the element of interest is in fact present and contributing to the gamma radiation detected at the higher neutron energy.

During the detection process the tool 24 is lowered in the observation borehole to a point adjacent to or below the oil bearing formation 10. The tool is then raised in increments over the depth of the formation and a gamma ray energy spectrum, such as those shown in FIG. 5, is generated from the gamma rays detected at each elevation. As will be appreciated, the particular depth increment between detection points used in a given case will vary with the formation and with the degree of vertical definition required. The tool 24 includes a suitable neutron source, as discussed more fully hereinafter, for use where radioactive elements are not employed.

From the gamma ray spectra generated, the presence of the element or elements of interest, e.g. a tracer element added to the flood fluid, at a particular depth is detected as an indication of the arrival at such elevation of the flood front. This process is repeated as necessary until the arrival of the flood front is detected for each elevation investigated. Since a log of the formation is run over a period of time a vertical profile such as that shown at 28 in FIG. 6 can be constructed, in which time of arrival (as indicated by detection of the tracer element) is plotted against depth. Such a profile depicts the shape and progress of the flood front over the depth of the formation. Taking the profile 28 of FIG. 6 as representative of the front 22B of FIG. 1, it may be seen from the bulge 30 in profile 28 that fingering, as indicated at 32 in FIG. 1, has occurred and that the front 22B as a whole is progressing more slowly. This knowledge helps in arriving at an accurate figure for the "time to flood", which is used to measure the production capability of a formation. The "time to flood" is a measure of how long it will take the flood front to reach the producing well and thus is a measure of the quantity of oil that may still be extracted and the profitability of continuing the flooding procedure. By providing additional observation boreholes over the distances between the observation borehole 18B and the producing well 14 the further progress and shape of the front 22B as it approaches the producing well 14 may be monitored. The same is of course true for flood front 22A.

Figure 2A:
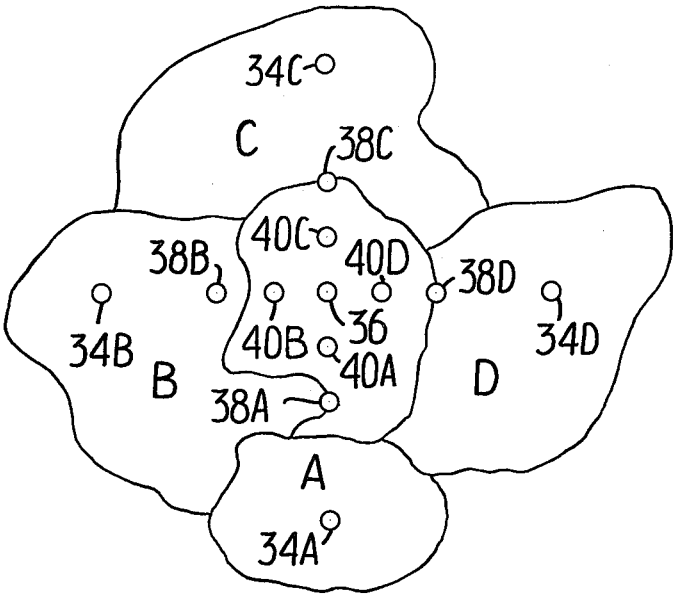
FIGS. 2A and 2B are schematic plan views of an oil field showing the possible placement of injection wells, observation boreholes and producing wells and further showing representations of a horizontal flood front profile.
Figure 2B:
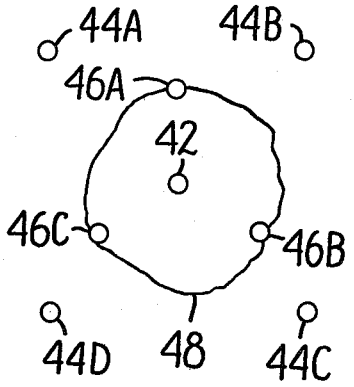

Still other features of the invention will be apparent from FIGS. 2A and 2B, which illustrate how flood front detection in accordance with the invention is useful in controlling the flooding operation so as to maximize oil recovery. In FIG. 2A, four injection wells 34A, 34B, 34C and 34D are spaced in generally surrounding relation to a producing well 36. A first line of observation boreholes 38A, 38B, 38C and 38D is located between the injection wells 34A–34D and the producing well 36, and a second line of observation boreholes 40A, 40B, 40C and 40D is located between the first line boreholes 38A–38D and the producing well 36. The zones flooded by the injection wells 34A–34D are indicated by the letters A, B, C and D, respectively. According to the invention, the fluid injected into the respective zones A, B, C and D contains a different tracer element, i.e. the tracer in any one zone will have a characteristic gamma ray emission energy which differs from that of the tracer injected into any other zone. It is possible, therefore, to detect not only the movement of the combined flood front of zones A–D but also to determine the progress and shape of the individual flood zone fronts.

In the illustration of FIG. 2A, the flood front of zone B is shown as having passed its first-line observation borehole 38B and, due to an irregularity in the formation, to have also reached the first-line observation borehole 38A for flood zone A. This is an indication that the injection procedure should be slowed or stopped in zone B until the other flood zone fronts catch up. The flooding in zones C and D have reached their first-line observation boreholes, 38C and 38D, respectively, together and can be used as the norm. However, the front in zone A has not reached its first-line borehole 38A, indicating that the pressure or quantity of displacing fluid injected through well 34A should be increased.

The arrangement of FIG. 2B shows a single injection well 42 located between a number of producing wells 44A, 44B 44C and 44D. A group of three observation boreholes 46A, 46B and 46C surround the injection well 42, but are not on a direct line with the producing wells 44A–44D. Although there is less control over the advance of the flood front, indicated at 48 in FIG. 2B, with such an arrangement than with the arrangement of FIG. 2A, useful information concerning the shape and progress of the front may nevertheless be obtained. For example, it is possible to determine the "time to flood" to each of the producing wells 44A–44D. In proper circumstances, it may still be possible to exercise directional control over the progress of the front 48, e.g., by closing off the perforations in injection well 42 in the sector or sectors in which the front is moving too rapidly.

In any event, it will be appreciated that by providing observation boreholes about the periphery of a producing well, as in FIG. 2A, or about the periphery of an injection well, as in FIG. 2B, information is obtained in accordance with the invention concerning both the vertical profile and the horizontal profile of the flood front. It will be understood, of course, that the required degree of horizontal definition can be attained by selection of the horizontal spacing between adjacent observation boreholes. Generally, fewer boreholes (larger spacings) are possible with more uniform formations. The number and location of the injection wells may also be varied as needed to provide further control over flood front movement and configuration.

In the embodiment of FIG. 3, the tool 24 includes a neutron source 54 located at the upper end of the sonde. The source may be either of the chemical type, e.g. californium 252, or of the accelerator type, such as the 14 MeV generators disclosed in U.S. Pat. Nos. 3,461,291 to C. Goodman and 3,546,512 to A. H. Frentrop. If only radioactive elements are to be detected, the source 54 may be omitted or left dormant. Preferably, however, it will be included in the tool to afford the greatest flexibility in practicing the invention. Assuming a non-radioactive (stable) element has been selected as the tracer, the neutron source 54 is positioned opposite the formation at the depth to be investigated and the formation irradiated for a time sufficient to generate enough gamma rays to provide a statistically accurate spectrum. Depending on the tracer element employed and the type of gamma rays to be detected, the irradiation period may extend anywhere from a few seconds to an hour or more. For example, if aluminum is used as the tracer and activation gamma rays are detected, the required irradiation period is short enough to permit continuous movement of the tool 24 along the formation at the rate of 600 ft/hour.

The source 54 is preferably isolated by a neutron shield 56 to protect the downhole electronics from direct neutron irradiation and also to minimize activation of the detector 58 and the sonde portions adjacent the detector. To the same end, and particularly where a chemical neutron source is used, the detector 58 is preferably spaced a substantial distance from the source 54, e.g. on the order of 10 to 20 feet. Such spacing also functions to prevent early gamma rays, such as those resulting from inelastic scattering reactions within the borehole for example, from reaching the detector 58. Appropriate gamma ray shielding (not shown) may of course be provided within and around the sonde to further reduce unwanted gamma radiation at the detector.

The source-to-detector spacing may also serve to discriminate against unwanted gamma rays on a time basis. For instance, if activation gamma rays are to be detected, the portions of the time distribution of gamma rays following a neutron pulse in which inelastic scattering gamma rays, on the one hand, and thermal neutron capture gamma rays, on the other hand, predominate, which portions may be roughly identified as indicated in FIG. 4, can be substantially eliminated from the detected spectrum simply by the length of time taken to move the detector 58 upward along the formation to a position opposite the elevation previously irradiated by the source 54. Where it is desired to detect inelastic scattering gamma rays or thermal neutron capture gamma rays or short half-life activation gamma rays, a shorter source-to-detector spacing is preferred.

As may also be seen from FIG. 4, inelastic scattering gamma rays or thermal neutron capture gamma rays may also be selectively detected by appropriate gating of the detector 58 relative to the time of occurrence of the neutron pulse. In the usual case, the type of gamma rays of interest, e.g., capture gamma rays, would be detected following each of a number of neutron pulses and the counts per channel accumulated over a period long enough to achieve a statistically accurate spectrum. Activation gamma rays may of course also be selected by time-gating of the detector rather than by movement of the tool 24.

As mentioned, the detector 58 preferably comprises a high-resolution gamma ray detector, and may, for example, be of the solid-state Ge type disclosed in U.S. Pat. No. 3,633,030 to S. Antkiw, the pertinent portions of which are incorporated herein by reference. The resolution of such a detector is so good that it can distinguish between aluminum with an activation spectral line at 1.779 MeV and manganese with a line at 1.811 MeV. Upon detection of the gamma rays emanating from the formation, the detector 58 generates a corresponding distribution of signals, whose amplitudes are proportional to the energies of the incident gamma rays. The time distribution of different types of gamma rays and their relative intensities is illustrated in FIG. 4. These signals are amplified in amplifier 60 and applied to a multichannel pulse height analyzer (PHA) 62. The PHA 62 may be of any conventional type, such as a single-ramp (Wilkinson run-down) type, which is operable to sort incoming pulses according to amplitude into a number of energy segments or channels over the gamma ray energy range of interest.

The PHA 62 will be understood to include the usual low-level and high-level discriminators for selection of the energy range to be analyzed and linear gating circuits for control of the time portion of the detector pulses to be analyzed. Appropriate signals may be generated in a downhole programmer 64 in conventional fashion and applied to the PHA 62 to adjust discriminator levels, if desired, and to enable the linear gating circuits. Where a pulsed neutron generator is used as the source 54, signals of predetermined duration and repetition rate may be transmitted to the source from the programmer 64, as indicated by the broken-line conductor 65 in FIG. 3, in order to cause the generator to produce a neutron pulse. Although shown downhole in FIG. 3, it will be understood that the PHA 62 and the programmer 64 could be located at the surface if desired.

The output signals from the PHA are applied to data link circuits 66 for transmission to the surface. Circuits 66 may be of any conventional construction for encoding, time-division multiplexing or otherwise preparing the data-bearing signals applied to them in a desired manner and for impressing them on the cable 25, and the specific forms of the circuits employed for these purposes do not characterize the invention. Where the PHA 62 is located downhole, the data link circuits disclosed in the copending, commonly-owned U.S. application Ser. No. 563,507, filed Mar. 31, 1975 by W. B. Nelligan for "System for Telemetering Well-Logging Data", now U.S. Pat. No. 4,012,712, are particularly useful.

At the surface the transmitted data-bearing signals are received in data link circuits 68, where they are amplified, decoded and otherwise processed as needed for application to a computer 70 and to a tape recorder 72. The computer sums the counts in each channel over the energy range of interest and transmits signals indicative thereof to a visual plotter 74 to generate plots of the gamma ray spectra. Two such plots 76 and 78 are illustrated in FIG. 5. The tape recorder 72 and plotter 74 are conventional and are suitable to provide the desired record of logging signals as a function of depth. The usual cable-following linkage, indicated schematically at 80, and depth indicator 82 are provided for this purpose.

As will be appreciated, the peaks of the spectra 76 and 78 of FIG. 5 are characteristic of particular elements of the formation and borehole constituents, one of which will correspond to each of the tracer elements of interest. Where there is sufficient resolution between the peaks, the peak characteristic of a particular tracer may be identified by peak form analysis and the number of counts under the peak determined. This count may then be used to detect whether or not the tracer has in fact arrived at the observation borehole in question. This might be done, for example, by comparing the count thus determined against a predetermined reference count. Such comparison could readily be carried out in computer 70, with an output signal indicative of the arrival being sent to the plotter 74 for recording. The computer could then also compute the corresponding time of arrival of the tracer at the observation borehole and instruct the plotter 74 to plot such time-of-arrival information as a function of depth as indicated in FIG. 6. In certain cases, the log analyst might be able to detect the arrival of the tracer based on visual inspection of the spectra plots generated, as in FIG. 5. In cases where only one tracer with a sharp peak is used it is possible to forego the creation of a spectrum by eliminating the PHA and relying on threshold detectors to create a small gamma ray energy window or range. A sufficient number of counts in this range would indicate the arrival of the front.

Additionally, spectra may be taken at two different times and the counts measured for the same peak in each spectrum so as to perform a half-life measurement. Such a half-life determination could then be used as a basis for extrapolating backwards to arrive at an estimate of the concentration of the element in the formation, with the concentration measurement then used for comparison with a reference value for detection purposes. By measuring concentration it can be determined when the flood front has arrived, as well as the uniformity of the propagation of the front.

The foregoing half-life measurements and concentration extrapolations are well known straight-forward computations once the peak counts at two different times are known and may be readily implemented in the computer 70.

Half-life measurements are also useful where long half-life contaminants having spectral lines which interfere with the tracer line are present in the formation or flood fluid. Such a situation is depicted in FIG. 5, where for illustrative purposes it is assumed that the tracer element is magnesium and that the formation contains manganese, both of which have an activation gamma ray peak near 0.840 MeV when excited into the isotopes magnesium 27 and manganese 56, respectively. This peak is indicated at 84 in plot 76 of FIG. 5, which represents a spectrum taken one minute after the termination of neutron irradiation, and at 86 in plot 78, which represents a spectrum taken ten minutes after termination of neutron irradiation. Since the activation gamma ray half-lives of manganese 56 and magnesium 27 are 2.58 hours and 9.45 minutes, respectively, the later spectrum 78 should show a marked decrease in the 0.840 MeV peak when magnesium 27 is present and contributing to the first spectrum 76. As a result, a determination can be made whether the tracer has been received, as is the case in the example of FIG. 5, or whether the original peak was due merely to an element (manganese in this instance) normally found in the formation. If desired, spectra may be taken at a number of different times for purposes of identifying elements on the basis of half-life. The number and timing of such spectra will be dependent on the characteristics of the particular tracer element or elements used and the other elements expected to be found in the formations under investigation. For instance, the detection period might be delayed until contaminants with short half-lives have died out. Control of the time of occurrence and the duration of the detection period or periods, as the case may be, may be effected by the downhole programmer 64, through gating signals transmitted to the PHA 62, or by means of gating or other control signals sent downhole by the computer 70. Such signals prefereably are related to the time of neutron irradiation, and may, for example, be timed from the start or the end of the irradiation interval. Preferably, a measurement of elapsed time between the end of neutron irradiation and the beginning of detection will be made in order to permit extrapolation backward to determine element concentrations.

In those cases in which the tracer is an element normally found in the formation, it is desirable to run a complete spectrum log of the formation before the flood front arrives. The arrival of the flood front may then be detected by noting an increase in the amplitude of the peak for the tracer, thereby indicating an increase in its concentration. Another way of distinguishing a tracer from the formation elements is by taking a spectrum of gamma rays produced by a low energy neutron source, e.g. a californium 252 source having a mean energy of 2.3 MeV, and thereafter taking a second spectrum of gamma rays produced by a high energy source, e.g. the 14 MeV pulsed neutron source of the aforementioned Goodman and Frentrop patents. Since activation is a threshold function, i.e. activation will occur only above a certain incident neutron energy, elements whose thresholds are above the level of the low energy source will only be activated by the high-energy source. Hence, they will emit gamma rays only when irradiated by the high-energy source. Representative elements for the neutron source energies given, i.e. 2.3 MeV and 14.0 MeV, are iron and manganese. To this end, either two sources may be included in the tool 24 or a source capable of producing neutrons of two different energies may be provided. An appropriate source of the latter type is disclosed in the aforementioned U.S. Pat. No. 3,461,291 to C. Goodman, the pertinent portions of which are hereby incorporated herein by reference.

If desired, profiles such as that illustrated in FIG. 6 may be plotted on a common chart for a number of different observation boreholes. This permits ready determination of the movement and shape of the flood front among the several boreholes. Where such boreholes are spaced about the periphery of a producing well, as shown in FIG. 2A, or an injection well, as shown in FIG. 2B, such a combined plot affords information both of the horizontal profile and of the vertical profile of the flood front over the depth of the formation investigated. Alternatively, the computer 70 could be used to drive a CRT graphical display so as to combine the data of FIGS. 2 and 6 to produce a three-dimensional plot of the surface of the flood front relative to the producing well. Such a plot could be rotated by the operator through commands to the computer in order to better view the front.

A plot such as that shown in FIG. 2A or FIG. 2B may be made after the flood front has passed all of the first line of observation boreholes if the computer 70 is given the relative positions of the boreholes. An assumption is made that the flood front is progressing uniformly in a cylindrical fashion from each injection well. The time at which each front passed its first observation borehole is then used to calculate its diameter at the time the plot is drawn. While such a plot is not exact it does give a rough approximation of the shape of a complete front, the amount of oil remaining and the time required to complete the flooding operation, i.e. the "time to flood." If such a plot is repeated for a second line or third line of observation wells, it can be seen whether the steps taken to equalize the progress of the front have been successful.

While the invention has been particularly shown and described with reference to preferred embodiments thereof, it will be understood by those skilled in the art that various changes in form and details may be made therein without departing from the spirit and scope of the invention. All such changes, therefore, are intended to be included within the spirit and scope of the appended claims.

We claim:

1. A method of investigating in situ the profile of a flood front in an oil-bearing earth formation as it progresses through the formation towards a producing well communicating with the formation from a plurality of injection wells traversing the formation and spaced about the periphery of the producing well, comprising the steps of:

adding a tracer element to the flood fluid injected through each injection well, each tracer element having a characteristic gamma ray emission energy which differs from that of the other tracer element or elements, at least one of the tracer elements being a normally stable element which emits gamma rays at said characteristic energy when irradiated with nuclear radiation;

irradiating the formation at each of a plurality of observation boreholes with said nuclear radiation to induce the emission by said tracer element of gamma rays at said characteristic energy, said observation boreholes being located intermediate said injection wells and said producing well;

detecting gamma rays emanating from the formation at each of said plurality of observation boreholes located intermediate to said injection wells and said producing well; and obtaining, by spectral analysis of the detected gamma rays, an indication of the presence of said tracer elements for use in determining the time of arrival at said observation boreholes of the flood fluids from the respective injection wells.

2. The method of claim 1 wherein said detecting and obtaining steps are repeated at each of a plurality of elevations over the depth of the formation to provide information about the vertical profile of the flood front in the formation.

3. The method of claim 2 further comprising the step of recording the time of arrival at each elevation of at least the first tracer element to so arrive.

4. The method of claim 1 wherein said irradiating, detecting and obtaining steps are repeated at each of a plurality of elevations over the depth of the formation to provide information about the vertical profile of the flood front in the formation.

5. The method of claim 1, wherein gamma rays emitted by a contaminant interfere with gamma rays emitted by the tracer, further comprising the steps of:

irradiating the formation with nuclear radiation having an energy different from that of the first-mentioned nuclear radiation;

detecting gamma rays emanating from the formation as a result of said further irradiating step; and obtaining, by comparison of the further detected gamma rays to the first detected gamma rays, an indication of whether the contaminant is present in the formation.

6. The method of claim 1, wherein gamma rays emitted by a contaminant having a half-life different than that of said tracer element interfere with gamma rays emitted by the tracer, further comprising the steps of:

detecting gamma rays emanating from the formation at a later time; and obtaining, by comparison of the further detected gamma rays to the first detected gamma rays, an indication of whether the contaminant is present in the formation.

7. The method of claim 1 wherein:

the irradiating step comprises irradiating the formation with time-spaced pulses of nuclear radiation; and the detecting step comprises detecting that portion of the time distribution of gamma rays emanating from the formation following each radiation pulse which corresponds to the period during which the tracer element to be detected emits gamma rays of said characteristic energy.

8. The method of claim 1 wherein the step of obtaining an indication of the presence of a tracer element comprises measuring the number of gamma rays detected in a unit of time having the energy characteristic of said tracer element.

9. The method of claim 1 wherein the step of obtaining an indication of the presence of a tracer element comprises:

measuring the number of detected gamma rays in a unit of time having the energy characteristic of said tracer element at, at least, two different times; and determining from the measured numbers the rate of decay of the detected gamma rays, for identifying said tracer element on the basis of its half-life.

10. A method of increasing the recovery of oil from an oil-bearing formation through a producing well communicating therewith, comprising the steps of:

injecting a flood fluid containing a tracer element into the oil-bearing formation through a plurality of injection wells spaced about the periphery of the producing well so as to drive the oil in the formation before a flood front towards the producing well, the tracer element injected through any one injection well having a characteristic gamma ray emission energy which differs from that of the tracer element injected through any other injection well;

detecting gamma rays emanating from the formation at each of a plurality of observation boreholes spaced about the periphery of the producing well and located intermediate the producing well and the injection wells;

determining, by spectral analysis of said detected gamma rays, the presence of said tracer elements for use as an indication of the time of arrival at said observation boreholes of the flood fluids, from the respective injection wells; and controlling the injection of the flood fluid through one or more of the injection wells on the basis of the times of arrival of the respective flood fluids at the observation boreholes so as to control the progress towards the producing well of the flood front formed by the injection of flood fluid through said plurality of injection wells.

11. The method of claim 10 wherein the observation boreholes are cased.

12. The method of claim 10 wherein said detecting and determining steps are repeated at each of a plurality of elevations over the depth of the formation to provide information about the vertical profile of the flood front in the formation.

13. The method of claim 12 wherein:

the observation boreholes are spaced about the periphery of the producing well so as substantially to surround the producing well, whereby information is obtained concerning the horizontal profile of the flood front as well as the vertical profile; and the injection of the flood fluid through one or more of the injection wells is controlled so as to control both the horizontal and the vertical progress of the flood front towards the producing well.

14. A method of investigating in situ the profile of a flood fluid front as it progresses through an oil-bearing formation from at least one injection well traversing the formation towards a producing well communicating with the formation, comprising the steps of:

detecting gamma rays emanating from the formation at a plurality of elevations over the depth of the formation in at least one observation borehole traversing the formation, said observation borehole being located between the injection well and the producing well;

determining, by analysis of the gamma rays detected at each of said elevations, the arrival of the flood fluid at said elevation in the observation borehole, said analysis including the detection of the presence of a tracer element emitting gamma radiation within a given energy range and having different concentrations in the formation and the flood fluid; and recording the time of arrival of the flood fluid at each of said elevations to produce a representation of the vertical profile of the flood fluid as it reaches said observation borehole.

15. The method of claim 14, wherein said tracer element is added to the flood fluid.

16. The method of claim 14 wherein said tracer element is radioactive and spontaneously emits gamma rays within said given energy range.

17. The method of claim 14 wherein:

said tracer element is a normally stable element emitting gamma rays within said given energy range when irradiated with nuclear radiation; and further comprising the step of irradiating the formation at each of said elevations with said nuclear radiation to induce the emission by said element of gamma rays within said energy range.

18. The method of claim 17 further comprising the steps of:

irradiating the formation with nuclear radiation having an energy different from that of the first-mentioned nuclear radiation;

detecting gamma rays emanating from the formation as a result of said further irradiating step; and determining, by comparison of the further detected gamma rays to the first detected gamma rays, the presence of a contaminant emitting gamma radiation within said given energy range.

19. The method of claim 17 further comprising the steps of:

detecting gamma rays emanating from the formation at a later time; and determining, by comparison of the further detected gamma rays to the first detected gamma rays, the presence of a contaminant emitting gamma radiation within said given range on the basis of half-life.

20. The method of claim 17 wherein:

the irradiating step comprises irradiating the formation with time-spaced pulses of nuclear radiation; and the detecting step comprises detecting that portion of the time distribution of gamma rays emanating from the formation following each radiation pulse which corresponds to the period during which said tracer element emits gamma rays within said given energy range.

21. The method of claim 14 wherein said determining step comprises measuring the number of gamma rays detected in a unit of time in said given energy range.

22. The method of claim 14 wherein said determining step comprises.

measuring the number of gamma rays detected in a unit of time in said given energy range at, at least, two different times; and determining from the measured number the rate of decay of the detected gamma rays, for identifying said tracer element on the basis of its half-life.

23. The method of claim 14 wherein:

there are a plurality of observation boreholes spaced about the periphery of the producing borehole; and the detecting, determining and recording steps are carried out at a plurality of elevations over the depth of the formation in each of said observation boreholes.

24. The method of claim 23 further comprising producing a representation of the horizontal profile of the flood fluid profile at one or more of said elevations.

25. A method of investigating in situ the profile of a fluid flood front in an oil-bearing earth formation as it progresses through the formation towards a producing well communicating with the formation from a plurality of injection wells traversing the formation and spaced about the periphery of the producing well, comprising the steps of:

adding a tracer element to the flood fluid injected through each injection well, each tracer element emitting gamma rays at a characteristic gamma ray emission energy which differs from that of the other tracer element or elements, at least one of the tracer elements being radioactive and spontaneously emitting gamma rays at the characteristic gamma ray emission energy;

detecting gamma rays emanating from the formation at each of a plurality of observation boreholes located intermedate to said injection wells and said producing well;

measuring the number of detected gamma rays in a unit of time having the energy characteristic of said tracer element at, at least, two different times, and determining from the measured numbers the rate of decay of the detected gamma rays, for identifying said tracer element on the basis of its half-life and indicating the presence of said tracer elements for use in determining the time arrival at said observation boreholes of the flood fluids from the respective injection wells.

26. A method of investigating in situ the profile of a flood fluid front as it progresses through an oil-bearing formation from at least one injection well traversing the formation towards a producing well communicating with the formation, comprising the steps of:

detecting gamma rays emanating from the formation at a plurality of elevations over the depths of the formation in at least one observation borehole traversing the formation, said observation borehole being located between the injection well and the producing well, said gamma rays being detected at each of said elevations at a first time prior to the arrival thereat of the flood fluid and at a later second time when the flood fluid has arrived at said elevation;

determining, by analysis of the gamma rays detected at each of said elevations, a characteristic enabling detection of the arrival of the flood fluid at said elevation in the observation borehole, said characteristic being determined at both said first and second times and the arrival of the flood fluid being detected by comparing the two determined characteristics at each of said elevations to detect differences therebetween; and recording the time of arrival of the flood fluid at each of said elevations to produce a representation of the vertical profile of the flood fluid front as it reaches said observation borehole.

* * * * *